US008356610B2

(12) United States Patent
Ertle et al.

(10) Patent No.: US 8,356,610 B2
(45) Date of Patent: Jan. 22, 2013

(54) DOMESTIC DISHWASHER

(75) Inventors: Roland Ertle, Lauingen (DE); Erika Ulrike Ertle, legal representative, Lauingen (DE); Marion Ertle, legal representative, Lauingen (DE); Lisa Marie Ertle, legal representative, Lauingen (DE); Marco Andreas Ertle, legal representative, Lauingen (DE); Stephan Harlacher, Mödingen (DE); Bruno Reiter, Kösingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 700 days.

(21) Appl. No.: 12/087,134

(22) PCT Filed: Dec. 19, 2006

(86) PCT No.: PCT/EP2006/069880

§ 371 (c)(1),
(2), (4) Date: Dec. 22, 2009

(87) PCT Pub. No.: WO2007/074104

PCT Pub. Date: Jul. 5, 2007

(65) Prior Publication Data

US 2011/0155189 A1 Jun. 30, 2011

(30) Foreign Application Priority Data

Dec. 27, 2005 (DE) ..... 10 2005 062 471

(51) Int. Cl.
*B08B 3/02* (2006.01)

(52) U.S. Cl. ..... 134/186; 134/201; 68/208

(58) Field of Classification Search ..... 134/57 D, 134/58 D, 172, 184, 186
See application file for complete search history.

(56) References Cited

U.S. PATENT DOCUMENTS

| | | | | | |
|---|---|---|---|---|---|
| 2,287,397 | A | * | 6/1942 | Rupp | 415/56.6 |
| 3,183,839 | A | * | 5/1965 | Brunson | 417/300 |
| 3,290,909 | A | * | 12/1966 | Schwing et al. | 68/23 R |
| 3,294,102 | A | * | 12/1966 | Ruspino et al. | 134/186 |
| 3,346,000 | A | * | 10/1967 | Cushing | 137/216 |
| 3,630,373 | A | * | 12/1971 | Grazen | 415/198.1 |
| 4,255,079 | A | * | 3/1981 | Piegza | 415/11 |
| 5,868,011 | A | * | 2/1999 | Hawkins et al. | 68/208 |

(Continued)

FOREIGN PATENT DOCUMENTS

DE 1 900 706 U 9/1964

(Continued)

OTHER PUBLICATIONS

International Search Report PCT/EP2006/069880.

*Primary Examiner* — Frankie L Stinson
(74) *Attorney, Agent, or Firm* — James E. Howard; Andre Pallapies

(57) ABSTRACT

A dishwasher, in particular a domestic dishwasher having a detergent-solution pump for pumping dirty washing liquid out of a washing compartment; a discharge line connected to the detergent-solution pump on a pressure side thereof; a venting shaft located above the topmost liquid level of the washing compartment in fluid communication with the discharge line; and a first valve operationally disposed within the venting shaft, with the first valve being closed when the detergent-solution pump is operating and open when the detergent-solution pump is not operating, the dishwasher comprising a bypass line for operationally connecting the detergent-solution pump and discharge line, with the bypass line operationally venting the detergent-solution pump.

20 Claims, 1 Drawing Sheet

U.S. PATENT DOCUMENTS

| | | | |
|---|---|---|---|
| 2004/0163689 | A1 | 8/2004 | Lee |
| 2005/0115592 | A1 | 6/2005 | Lee |

FOREIGN PATENT DOCUMENTS

| | | | |
|---|---|---|---|
| DE | 1 914 744 | U | 4/1965 |
| DE | 195 37 944 | | 4/1997 |
| DE | 297 22 975 | U | 2/1998 |
| DE | 197 41 590 | | 3/1999 |
| DE | 10 2005 012 519 | * | 9/2006 |
| EP | 0 492 090 | | 7/1992 |
| EP | 1 543 760 | | 6/2005 |
| GB | 1386510 | * | 5/1975 |
| GB | 2 134 672 | * | 8/1984 |
| JP | 10-314496 | * | 12/1988 |
| JP | 08-061280 | * | 3/1996 |
| JP | 11-193791 | * | 7/1999 |
| JP | 2002-147391 | * | 5/2002 |
| JP | 2005-307823 | * | 11/2005 |
| KR | 2000002179 | * | 1/2000 |
| SU | 1052714 | * | 11/1983 |
| SU | 1109492 | * | 8/1984 |

* cited by examiner

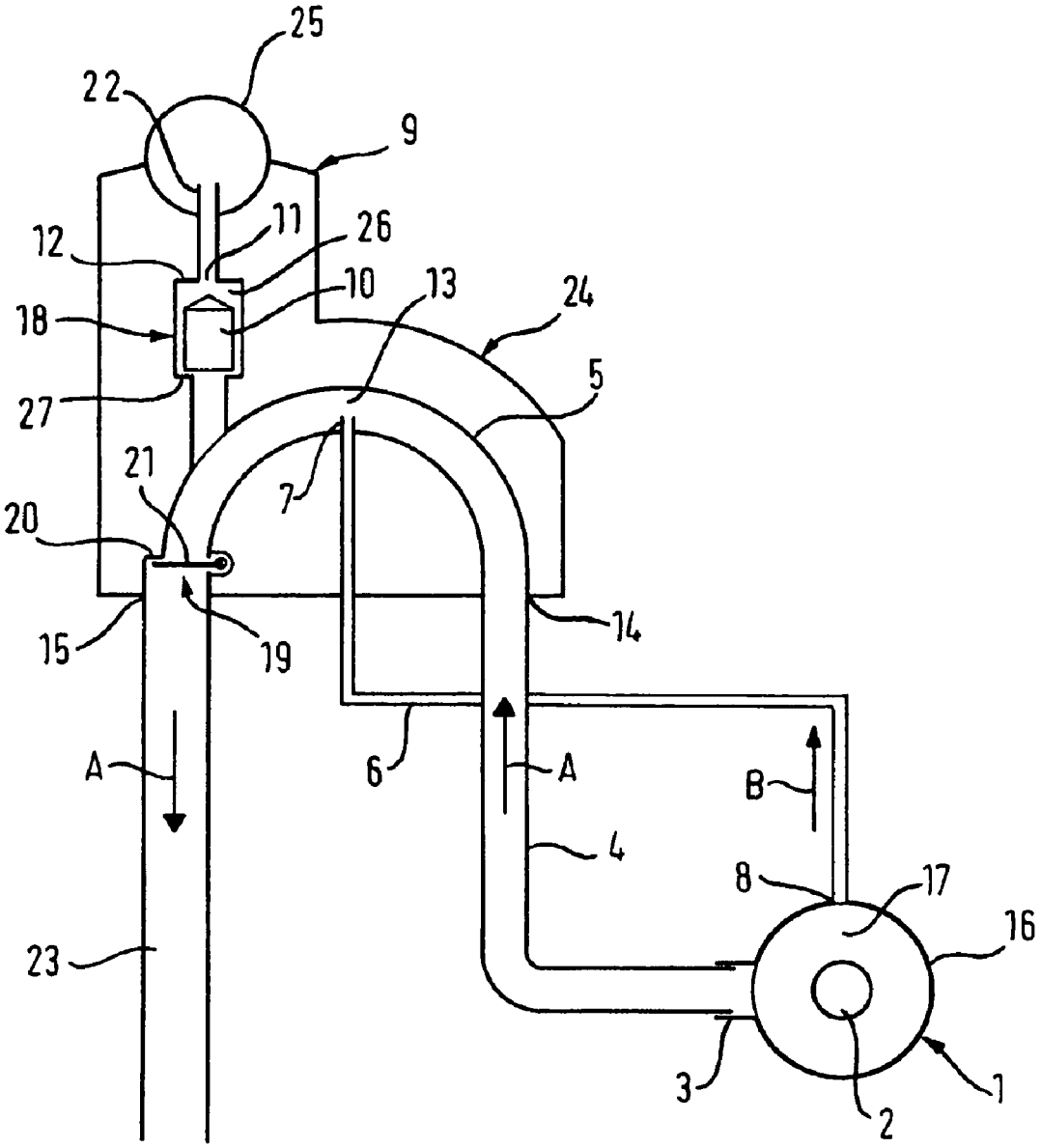
25
22
9
11
26
12
10
13
24
18
5
27
21
7
20
14
15
19
A
6
A
B
4
8
17
16
23
3
2
1

DOMESTIC DISHWASHER

BACKGROUND OF THE INVENTION

The invention relates to a dishwasher, in particular a domestic dishwasher, having a detergent-solution pump for pumping dirty washing liquid out of a washing compartment and having a discharge line that is connected to the detergent-solution pump on the pressure side and linked to a venting shaft located above the washing compartment's topmost liquid level, with a first valve that is closed when the detergent-solution pump is operating and otherwise open being located in the venting shaft.

A generic dishwasher of said type is known from DE 40 40 967 A1. It further has a second valve located in the discharge line, with said second valve being kept closed when the detergent-solution pump has not been actuated. The first valve serves to provide ventilating of the detergent-solution pump, as a result of which any air trapped therein can escape via the venting shaft so that the detergent-solution pump can immediately after being switched on start conveying the washing liquid requiring to be pumped away. The second valve serves to prevent washing liquid that is being conveyed by the detergent-solution pump into the discharge line from flowing back into the washing compartment.

Detergent-solution pumps of domestic dishwashers are usually not adequately able to convey air. At the end of a program section during which liquid is conveyed the detergent-solution pump is in the case of domestic dishwashers usually operated for a predefined running time for pumping away dirty washing liquid. When air is trapped in the detergent-solution pump a greater part of its predefined running time is owing to its low air-conveying capability needed for conveying the trapped air before the liquid requiring to be pumped away can be pumped away. It is consequently not possible for the entire volume of liquid requiring to be pumped away to be pumped away.

Depending on the detergent-solution pump's specific structural design the situation may even arise of its not being at all possible to convey liquid owing to air trapped in the detergent-solution pump. That can occur particularly in the case of detergent-solution pumps operated by means of a synchronous motor where the impeller wheel's direction of rotation is for design reasons indeterminable. Detergent-solution pumps of said kind therefore have their outflow stub pipe arranged as a rule centrally on the detergent-solution pump's pump housing. When an air pocket is trapped in the pump housing the situation can therein arise that washing liquid will through the impeller wheel's rotation be pressed against the pump housing's outer side owing to the greater mass compared with air, while air accumulates inside. That ring of air on the pump wheel will prevent a sufficient build-up of pressure for opening the second valve so that no washing liquid can be pumped away.

Further filling with washing liquid during an ensuing program section can in the worst case lead to overfilling and overflowing of the domestic dishwasher. In the event of a fault, the dishes will in any case always be re-soiled by the dirty washing liquid still remaining from the previous program section in proportion to the remaining, soiled volume of washing liquid.

BRIEF SUMMARY OF THE INVENTION

The object of the present invention is therefore to disclose a domestic dishwasher of the kind cited in the introduction in the case of which the described disadvantages are in a simple manner avoided.

Said object is inventively achieved by linking the detergent-solution pump and discharge line by means of a bypass line for venting the detergent-solution pump.

The possibility of venting the detergent-solution pump will be provided thereby in a domestic dishwasher of the kind cited in the introduction, as a result of which any air trapped in the detergent-solution pump can escape via the bypass line. It will be insured thereby that the washing liquid requiring to be pumped away by the detergent-solution pump can be reliably pumped in the direction of the discharge line.

The bypass line is according to a preferred embodiment variant connected by a first end to a reversing section—situated above the topmost liquid level—of the discharge line. The first end of the bypass line thus leads into a discharge-line section operatively linked to the venting shaft. It is thereby insured that any air trapped in the detergent-solution pump will be able to escape via the bypass line in the direction of the venting shaft so the washing liquid requiring to be pumped away will be conveyed after the detergent-solution pump has been running for a very short time.

In a further embodiment variant the bypass line leads at a second end into a section of a housing of the detergent-solution pump which is a top section in the direction of gravity. Account is taken through that embodiment variant of the fact that an air pocket inside the pump housing will form in a top section thereof. Thanks to an operative link between the second end of the bypass line and said section the air can reliably escape, preferably when the detergent-solution pump starts up, via the bypass line in the direction of the venting shaft.

To prevent dirt particles in the washing liquid from settling in the bypass line and forming an airtight seal therein, it is according to a further embodiment variant provided for the discharge line's cross-section to be reduced in the reversing section compared with at least one discharge-line section located in the liquid's flow direction in front of the reversing section. According to a preferred embodiment variant of the invention the reversing section of the discharge line is shaped essentially like an inverted "U" and located in the domestic dishwasher above the topmost liquid level. The reversing section is operatively linked to the venting shaft so that venting of the detergent-solution pump and discharge hose is reliably insured.

A Venturi effect is achieved by means of the reduction in cross-section in the area of the first end of the bypass line. The consequent suction effect in the bypass line results in its being rinsed through while the detergent-solution pump is operating with washing liquid requiring to be pumped away. The reduction in the discharge line's cross-section in the reversing section will increase the washing liquid's flow speed during pumping. The ensuing negative pressure in the bypass line first draws on the air located therein and finally on the washing liquid in the detergent-solution pump. Any dirt particles in the bypass line will be rinsed away thereby at the same time, as a result of which self-cleaning of the bypass line will have been provided.

The reduction in cross-section in the discharge line's reversing section is in a further embodiment variant produced by an inward projection of the first end of the bypass line.

It is in a further embodiment variant provided for the bypass line's cross-section to be larger at its first end than at its second end. It can thereby be insured that, owing to the Venturi effect, no dirt particles will be able to settle in said line because its cross-section increases in the flow direction. The bypass line's functional reliability will hence always be insured.

It is furthermore advantageous for a sieve for filtering dirt particles to be located on the second end of the bypass line. Self-cleaning of the sieve will be insured owing to the flow conditions prevailing in the pump housing.

The first valve is according to a further embodiment variant of the invention a float valve, with the float being able to close an opening located in a transverse wall of the venting shaft and serving as a valve seat. A measure for keeping the valve open when the detergent-solution pump has not been actuated is obviated by means of the advantageous embodiment of the first valve in the venting shaft as a float valve because the float will sink and the first valve hence remain open when washing liquid being conveyed is not present. On the other hand the float valve will be made to rise while washing liquid is being conveyed so that said valve will reliably seal the venting shaft.

In a further embodiment variant a second valve is provided that is kept closed when the detergent-solution pump has not been actuated and prevents rinsing water from flowing back into the washing compartment.

The second valve is according to a preferred embodiment embodied as a clapper valve that is pretensioned against the liquid's flow direction and has a bearing as the valve seat for a clapper-valve body. When the washing liquid is being conveyed by the detergent-solution pump, the clapper valve will be made to open by the pressure built up by the washing liquid. If, by contrast, a pressure is produced counter to the liquid's flow direction then the clapper-valve body will be pressed firmly onto the valve seat, as a result of which washing liquid will have been effectively prevented from flowing back in the direction of the detergent-solution pump and hence into the washing compartment. The clapper-valve body can with its bearing receptacles be embodied as a single piece made of an elastic material. The clapper-valve body will be easy to manufacture thanks to said measure and rendered easier to install.

The second valve is in one embodiment located in the discharge line in the liquid's flow direction behind where the discharge line joins the venting shaft. Venting of the discharge line and detergent-solution pump can be insured thereby in conjunction with the bypass line. That arrangement will at the same time prevent the domestic dishwasher from being emptied dry owing to negative pressure in a domestic drainage pipe to which the discharge line is connected.

The second valve is in another embodiment located in a feeder line to the detergent-solution pump. Washing liquid's flowing back into the detergent-solution pump via the discharge line and, where applicable, the bypass line will be tolerated in that constellation. The second valve assigned to the pump feeder will, though, effectively insure that the dirty washing liquid cannot enter the washing compartment. Venting of the discharge line and detergent-solution pump as well as washing liquid's being prevented from being drawn back out of the domestic dishwasher owing to a negative pressure in the domestic drainage pipe will be reliably insured by the first valve.

The second valve is in a third embodiment a valve in the bypass line and a valve in the discharge line in the liquid's flow direction in front of where the discharge line joins the venting shaft. The above-described advantages will be achieved in the case of that variant also.

In a further advantageous embodiment variant the discharge line's reversing section, the venting shaft, an air-outlet nipple of the venting shaft, the first valve in the venting shaft, the second valve in the discharge line, and a section—facing the first end—of the bypass line have been combined into a structural unit made largely of plastic. Said structural unit can be attached to the domestic dishwasher's washing compartment in a simple manner.

BRIEF DESCRIPTION OF THE DRAWINGS

FIG. 1, in a longitudinal section, schematically shows venting of a detergent-solution pump of a domestic dishwasher.

DETAILED DESCRIPTION OF THE PRESENT INVENTION

The invention will be explained in more detail below with the aid of a FIGURE. In a longitudinal section, the single FIGURE schematically shows venting of a detergent-solution pump of a domestic dishwasher.

In the case of a domestic dishwasher having a detergent-solution pump 1 for pumping away washing liquid at the end of a program section with the conveying of liquid from a washing compartment (not shown), a discharge line 4 leads from the detergent-solution pump 1 to a discharge hose (not shown) and thence into a domestic drain. The discharge line 4 is in the case of the inventive domestic dishwasher connected to an outlet nipple 3 of the detergent-solution pump 1. A reversing section 5, shaped like an inverted "U", of the discharge line 4 is connected to a venting shaft 9. The connection between the venting shaft 9 and reversing section 5 is in the case of the inventive domestic dishwasher located in a structural unit 24. The washing liquid pumped away by the detergent-solution pump 1 is ducted through the discharge line 4 in the liquid's flow direction indicated by arrows A from the detergent-solution pump's outlet nipple 3 via the reversing section 5 and line section 23 into the domestic drain via the discharge hose. The venting shaft 9 is connected to the washing compartment via an air inlet 25 that projects through an expansion opening (not shown) of the washing compartment above the highest liquid level into the washing compartment's interior and is secured there tight against the washing compartment possibly by means of a spigot nut (not shown) with a washer possibly in between.

The air introduced into the structural unit 24 from the washing compartment via the air inlet 25 is ducted away via an air-outlet nipple 22, possibly through an air-ducting hose (not shown) and an outlet opening on the domestic dishwasher.

The connection between the venting shaft 9 and the reversing section 5 of the discharge line 4 is provided by means of an opening 11 located in a transverse wall 12 linked to a cavity 26. The opening 11 serves as a valve seat for a float 10 of a valve 18 in the venting shaft 9. The float 10 is embodied as, for instance, a hollow cylinder having a hollow conical tip positioned towards the opening 11. The opening 11 can for improved seating of the conical tip of the float 10 be provided towards the float with a truncated-cone shaped expansion. The float 10 will rest on the bearing 27 of the cavity 26 when the detergent-solution pump has not been actuated.

Located in the reversing section 5, ducted in the structural unit 24, of the discharge line 4 in the liquid's flow direction A behind where the reversing section 5 joins the venting shaft 9 is a valve 19. The valve 19 at the end of the section—located in the liquid's flow direction A—of the reversing section 5 is embodied as, for instance, a clapper valve pretensioned against the liquid's flow direction A. When the detergent-solution pump has not been actuated, a clapper-valve body 21 of the valve 19 rests in the manner shown in the FIGURE on a bearing 20 of the reversing section 5. When the detergent-solution pump 1 has been actuated, the clapper-valve body 21 is swiveled around a rotatable axle in the direction of the liquid's flow direction A.

The valve 19 could in another variant (not shown), likewise in the form of a clapper valve pretensioned against the liquid's flow direction, be located in the liquid's flow direction in a feeder line to the detergent-solution pump 1 that is connected to an inlet nipple 2 of the detergent-solution pump 1. That is not shown further in the FIGURE.

The FIGURE shows by way of example the arrangement of the outlet nipple 3 of the detergent-solution pump 1 in a typical manner for detergent-solution pumps of the kind operated by means of a synchronous motor. The outlet nipple 3 is located centrally on a pump housing 16 and extends in a horizontal direction. It may therein happen that an air pocket forms in a top section 17 of the pump housing 16. Because said air pocket may in the most unfavorable cases even totally prevent washing liquid from being pumped away by the detergent-solution pump, the inventive domestic dishwasher provides for a bypass line 6 extending between the top section 17 of the pump housing 16 and the reversing section 5 of the discharge line 4. A first end 7 of the bypass line 6, which end projects into the reversing section 5 of the discharge line 4, is therein arranged such that there is an operative link to the venting shaft 9. A second end 8 of the bypass line 6 leads into the top section 17 of the pump housing 16.

It is insured by the bypass line 6 that when the detergent-solution pump 1 is started any air pocket therein will be able to escape through the venting shaft 9 via the bypass line 6 and the reversing section 5 of the discharge line 4. Washing liquid can hence be conveyed in the direction of the domestic drain via the discharge line 4 shortly after the detergent-solution pump has been put into operation, with the valve 19 sealing the venting shaft 9 and the valve 19 simultaneously opening owing to the flow of the rinsing water being pumped away.

The first end 7 of the bypass line 6 projects into the reversing section 5 of the discharge line 4 such as to produce a reduction 13 in cross-section in the reversing section 5. An increased washing-liquid flow speed will be produced thereby in the region of the reduction 13 in cross-section when the detergent-solution pump 1 is operating, as a result of which a suction will be generated in the bypass line 6 in the direction of the arrow identified by the reference letter B so that washing liquid will likewise be drawn through the bypass line 6 from the detergent-solution pump 1 and recombined with the washing liquid in the reversing section 5 at the first end 7. Rinsing of the bypass line 6 will insure that any impurities settling in the bypass line 6 will be removed. It is therein favorable for the bypass line 6 to be provided at its second end 8 with a sieve for keeping away coarse dirt.

The cross-section of the bypass line 6 can in a variant not shown increase in size from the second end 8 towards the first end 7. The increase in cross-section in the liquid's flow direction B will reliably cause any dirt settling in the bypass line 6 to be removed during rinsing. Blocking of the bypass line 6 will be prevented thereby so that the functionality of venting the pump housing 1 can be reliably insured in any situation.

The reversing section 5 of the discharge line 4, the venting shaft 9, the air-outlet nipple 22 of the venting shaft 9, the first valve 18 in the venting shaft, the second valve 19 of the discharge line, and a section—facing the first end—of the bypass line can advantageously be combined into a single structural unit 24 made largely of plastic. The discharge line 4 will then be connected to an inlet nipple 14 of said structural unit 24. The line section 23 will be connected to an outlet nipple 15 of the structural unit 24. The structural unit 24 is advantageously easy to attach to a washing compartment or housing component of the domestic dishwasher.

Furnishing the bypass line 6 will hence enable a dishwasher to be provided where both the detergent-solution pump 1 and the discharge line 4 are vented. The result will be reliable venting of the pump housing 16 with no displacement of washing liquid via the venting bypass. The bypass line will furthermore enable the valve 19 acting to prevent flow-back to be located in the feed to the detergent-solution pump 1. Additional venting while the detergent-solution pump is operating is moreover provided so that any air drawn in during operation can already be discharged in the pump housing 16 of the detergent-solution pump 1.

LIST OF REFERENCE NUMERALS/LETTERS

1 Detergent-solution pump
2 Inlet nipple
3 Outlet nipple
4 Outflow line
5 Reversing section
6 Bypass line
7 First end of the bypass line
8 Second end of the bypass line
9 Venting shaft
10 Float
11 Opening
12 Transverse wall
13 Reduction in cross-section
14 Inlet nipple
15 Outlet nipple
16 Pump housing
17 Top section of the pump housing
18 First valve
19 Second valve
20 Bearing
21 Clapper-valve body
22 Air-outlet nipple
23 Line section
24 Structural unit
25 Air inlet
26 Cavity
27 Bearing
A Flow direction of liquid
B Flow direction of liquid

The invention claimed is:

1. A dishwasher, comprising: a detergent-solution pump; a discharge line that is connected to the detergent-solution pump on a pressure side thereof; a venting shaft in fluid communication with a reversing section of the discharge line; a first valve operationally disposed within the venting shaft; and a bypass line operationally connecting the detergent-solution pump and discharge line for venting the detergent-solution pump.

2. The dishwasher according to claim 1 wherein the bypass line is connected by a first end to the reversing section, at a point above a topmost liquid level, of the discharge line.

3. The dishwasher according to claim 2 wherein a cross-section of the discharge line is reduced in the reversing section compared with at least one section of the discharge line upstream of the reversing section.

4. The dishwasher according to claim 3 wherein the reduction in cross-section in the reversing section of the discharge line is produced by an inward projecting of the first end of the bypass line.

5. The dishwasher according to claim 1 wherein a second end of the bypass line leads into a top section of a housing of the detergent-solution pump.

6. The dishwasher according to claim 1 wherein a cross-section of the bypass line is larger at its first end than at its second end.

7. The dishwasher according to claim 1 wherein a sieve for filtering dirt particles in the washing liquid is provided at a second end of the bypass line.

8. The dishwasher according to claim 1 wherein the first valve is a float valve having a float member, with the float member being able to close an opening located in a transverse wall of the venting shaft and serving as a valve seat.

9. The dishwasher according to claim 1 further comprising a second valve.

10. The dishwasher according to claim 9 wherein the second valve is embodied as a clapper valve that is biased against a liquid's flow direction and has a bearing as a valve seat for a clapper-valve body.

11. The dishwasher according to claim 9 wherein the second valve is located in the discharge line in a liquid flow direction downstream of where the discharge line joins the venting shaft.

12. The dishwasher according to claim 9 wherein the second valve is located in a feeder line to the detergent-solution pump.

13. The dishwasher according to claim 9 wherein the second valve includes a valve in the bypass line and a valve in the discharge line in a liquid flow direction upstream of where the discharge line joins the venting shaft.

14. The dishwasher according to claim 9, wherein the second valve is closed when the detergent-solution pump is not in operation to prevent rinsing water from flowing back into the washing compartment.

15. The dishwasher according to claim 1 wherein the reversing section of the discharge line, the venting shaft, an air-outlet nipple of the venting shaft, the first valve in the venting shaft, a second valve in the discharge line, and a section of the bypass line facing the first end are formed as a structural unit made largely of plastic.

16. The dishwasher according to claim 1 wherein the venting shaft is located on a washing compartment of the dishwasher.

17. The dishwasher according to claim 1, wherein the dishwasher comprises a-domestic dishwasher.

18. The dishwasher according to claim 1, wherein the detergent-solution pump pumps dirty washing liquid out of a washing compartment of the dishwasher.

19. The dishwasher according to claim 1, wherein the venting shaft is located above a topmost liquid level of a washing compartment of the dishwasher.

20. The dishwasher according to claim 1, wherein the first valve is closed when the detergent-solution pump is operating and open when the detergent-solution pump is not operating.

* * * * *

UNITED STATES PATENT AND TRADEMARK OFFICE

CERTIFICATE OF CORRECTION

PATENT NO. : 8,356,610 B2
APPLICATION NO. : 12/087134
DATED : January 22, 2013
INVENTOR(S) : Ertle et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1245 days.

Signed and Sealed this
First Day of September, 2015

Michelle K. Lee

Michelle K. Lee
*Director of the United States Patent and Trademark Office*